US010190256B2

(12) United States Patent
Lauer

(10) Patent No.: US 10,190,256 B2
(45) Date of Patent: Jan. 29, 2019

(54) DEVICE AND METHOD FOR PRODUCING A STRAND OR A CABLE

(71) Applicant: CASAR Drahtseilwerk Saar GmbH, Kirkel (DE)

(72) Inventor: Bruno Lauer, Marpingen (DE)

(73) Assignee: CASAR DRAHTSEILWERK SAAR GMBH, Kirkel (DE)

( * ) Notice: Subject to any disclaimer, the term of this patent is extended or adjusted under 35 U.S.C. 154(b) by 390 days.

(21) Appl. No.: 14/412,042

(22) PCT Filed: Jul. 2, 2013

(86) PCT No.: PCT/DE2013/100243

§ 371 (c)(1),
(2) Date: Dec. 30, 2014

(87) PCT Pub. No.: WO2014/005577

PCT Pub. Date: Jan. 9, 2014

(65) Prior Publication Data

US 2015/0152596 A1 Jun. 4, 2015

(30) Foreign Application Priority Data

Jul. 2, 2012 (DE) ..... 10 2012 105 817

(51) Int. Cl.
*D07B 1/16* (2006.01)
*D07B 7/02* (2006.01)
(Continued)

(52) U.S. Cl.
CPC ..... *D07B 1/16* (2013.01); *D07B 1/06* (2013.01); *D07B 3/02* (2013.01); *D07B 7/02* (2013.01);
(Continued)

(58) Field of Classification Search
CPC ... D07B 1/06; D07B 1/16; D07B 3/02; D07B 7/02; D07B 7/025
(Continued)

(56) References Cited

U.S. PATENT DOCUMENTS 1,851,868 A * 3/1932 Rinek ..... D07B 5/12 57/295
3,058,867 A * 10/1962 Sperr ..... H01B 13/0214 156/52
(Continued)

FOREIGN PATENT DOCUMENTS

DE 879812 C 6/1953
EP 1022377 A1 7/2000
(Continued)

*Primary Examiner* — Shaun R Hurley
*Assistant Examiner* — Bao-Thieu L Nguyen
(74) *Attorney, Agent, or Firm* — Lucas & Mercanti, LLP; Klaus P. Stoffel

(57) ABSTRACT

A device for producing a strand or a cable, in particular a wire strand or wire cable, which device includes a rotatable arrangement for feeding cords to a twisting point, at which the cords are to be twisted with one another, and an installation for heating at least one of the cords. The heating installation is rotatable jointly with the feed arrangement. The heating installation is designed to heat a cord provided for forming a center strand or a cable core and/or cords for forming outer strands, and preferably has burner for fuel and/or an electrically operated heater.

16 Claims, 3 Drawing Sheets

(51) Int. Cl.
*D07B 1/06* (2006.01)
*D07B 3/02* (2006.01)

(52) U.S. Cl.
CPC ..... *D07B 7/025* (2013.01); *D07B 2201/2061* (2013.01); *D07B 2201/2065* (2013.01); *D07B 2207/404* (2013.01); *D07B 2207/4018* (2013.01)

(58) Field of Classification Search
USPC ..... 57/6, 11–12, 308–309, 282, 290; 156/184
See application file for complete search history.

(56) References Cited

U.S. PATENT DOCUMENTS 3,240,570 A * 3/1966 Grimes, Jr. ..... D07B 1/0673 174/128.1
3,398,518 A * 8/1968 Nimtz ..... D01H 13/30 28/239
3,410,077 A * 11/1968 Marzocchi ..... D02G 1/00 28/178
3,498,038 A * 3/1970 Shulver ..... C03C 25/26 156/161
3,530,661 A * 9/1970 Thomen ..... D07B 1/0693 57/15
3,559,390 A * 2/1971 Staschewski ..... B29C 65/20 156/47
3,605,393 A * 9/1971 Schroeder ..... D02G 1/162 28/252
3,672,141 A * 6/1972 Tomica ..... H01B 13/10 57/12
3,769,787 A * 11/1973 Rosenstein ..... D02G 3/385 57/227
3,872,659 A * 3/1975 Campbell ..... D07B 1/0693 140/149
4,009,561 A * 3/1977 Young ..... D07B 3/00 29/728
4,026,099 A * 5/1977 Phillips ..... D02G 1/165 28/273
4,034,547 A * 7/1977 Loos ..... D07B 1/0693 57/211
4,197,695 A * 4/1980 Hughes ..... D07B 1/0673 156/433
4,604,861 A * 8/1986 Matsuura ..... D07B 1/0693 57/311
4,825,629 A * 5/1989 Missout ..... G02B 6/4407 57/13
4,896,494 A * 1/1990 Cholley ..... H01B 13/0235 57/13
4,997,258 A * 3/1991 Oestreich ..... G02B 6/4491 264/1.28
5,083,419 A * 1/1992 Greifeneder ..... D02J 1/22 264/290.7
5,267,430 A * 12/1993 Payen ..... D02G 3/328 57/282
5,315,813 A * 5/1994 Ito ..... G02B 6/4491 57/13
6,722,117 B2 * 4/2004 Belcher, Jr. ..... D02G 1/20 57/205
7,326,854 B2 * 2/2008 Varkey ..... H01B 7/046 174/102 R
7,571,594 B2 * 8/2009 Pascoe ..... D02G 3/343 57/11
8,635,848 B2 * 1/2014 Mackey ..... D07B 7/025 57/311
2007/0125488 A1 * 6/2007 Brisson ..... B29C 53/665 156/184
2012/0298403 A1 * 11/2012 Johnson ..... D07B 1/02 174/130
2013/0174531 A1 * 7/2013 Stuendl ..... D02G 1/12 57/281
2014/0069074 A1 * 3/2014 Lauer ..... D07B 5/00 57/232

FOREIGN PATENT DOCUMENTS

FR 2438705 A1 5/1980
GB 1298012 A 11/1972
GB 1458086 A 12/1976

* cited by examiner

DEVICE AND METHOD FOR PRODUCING A STRAND OR A CABLE

The present application is a 371 of International application PCT/DE2013/100243, filed Jul. 2, 2013, which claims priority of DE 10 2012 105 817.2, filed Jul. 2, 2012, the priority of these applications is hereby claimed and these applications are incorporated herein by reference.

BACKGROUND OF THE INVENTION

The invention pertains to a device for producing a strand or a cable, especially a wire strand or a wire cable, which device comprises a rotatable arrangement for feeding cords to a twisting point, at which the cords are twisted around each other, and an installation for heating at least one of the cords. The invention also pertains to a method for producing the strand or the cable.

In a device of this kind known from prior use, wire strands are guided to the twisting point by way of a rotating twisting basket, where they are twisted around a core strand coated with plastic and thus pressed into the plastic material. To heat the plastic and thus to soften it, gas burners are provided, which are directed at the core strand. So as not to interfere with the rotational movement of the strands, these burners are arranged outside the area upstream of the twisting point, i.e., the area through which the rotating wire strands and the core strand are guided on their way to the twisting point. The disadvantage is that a relatively large area must be heated to soften the plastic, for which a large amount of energy is required.

SUMMARY OF THE INVENTION

The invention is based on the goal of creating a device of the type indicated above by means of which operations can be carried out in a more energy-efficient manner.

According to the invention, this goal is achieved in that the heating installation is rotatable along with the feed arrangement.

As a result of the invention, it becomes possible to arrange the heating installation within the above-mentioned area in which the rotating strands are guided to the twisting point.

As a result, the heat produced by the heating installation can be focused on the strand which is to be heated. Only a relatively small area needs to be heated, and thus less energy is consumed than is the case with the known device. This solution also prevents the device itself, especially the twisting basket and possibly a preform head of the feed arrangement, from being heated at the same time.

Additional advantages may also be mentioned. In the case of the known device, the amount of heat which the gas burners can produce to heat the core strand is limited by the need to prevent the rotating wire strands being fed to the twisting point from becoming so strongly heated along with the core strand that their mechanical properties are impaired. In the device according to the invention, however, the heat is focused, which means that the strand forming the core can be heated more strongly without the danger that the other strands will undergo significant heating. Especially when one of the strands is coated with plastic, as described above, and this strand must be softened for the sake of the cable-making process, the stronger heating of the plastic means that the softening can be conducted more quickly and that it is possible in turn to twist the strands at a faster speed.

Because, furthermore, the device according to the invention makes it possible to control the heating of the strand more effectively, it is also possible to make use of this heating to subject the strand to a stress-relief annealing prior to the twisting process and thus to achieve better mechanical properties. The service life of the strand or cable can thus be increased.

In an especially preferred embodiment of the invention, the heating installation is set up to heat the cord intended to form the core strand or core cable. In one embodiment the invention, furthermore, the heating installation, which advisably comprises a burner for fuel, preferably a gas burner, and/or an electrically operated heating installation, preferably a heating resistor, an infrared radiator and/or an induction coil, and/or a device for supplying hot air, is arranged in the free spaces formed between the cords leading to the twisting point. Alternatively or in addition, the heating installation can also be provided to heat the cords provided for the formation of the outer strands. This is found to be especially advantageous in cases where the heating installation of the device can be used to heat each of the cords used to produce the wire strand or wire cable in a controlled manner and thus to relieve their stress.

In another embodiment of the invention, the heating installation for direct heating is set up only for the cords intended to form the outer wire strands. The cords can be heated in such a way that they are so hot at the twisting point that, on contact with the plastic, they are pressed into the plastic as it softens, wherein the plastic becomes plastically deformed.

For the production of the strand or cable, furthermore, several of the cords, especially also the cords intended to form the outer strands, are coated with plastic, and the heating installation can be used to heat the plastic on each cord to its softening point. As a result, it becomes possible to arrange the cords in the cable or strand more homogeneously in the plastic. In one embodiment of the invention, only the cords provided to form the outer strands are coated with plastic. These become embedded in the plastic of the wire cable, and the plastic can form an outward-facing sheath around the wire cable.

It is advisable for the heating means to be arranged rotatably on the feed arrangement or on a mounting device attached to a base. Whereas it would also be conceivable to provide a separate drive to rotate the heating means on the mounting device in synchrony with the rotational movement of the feed arrangement, the heating means, in a preferred embodiment of the invention, is connected to the feed arrangement preferably by struts, so that the heating means rotates along with the feed arrangement.

The operating medium required to operate the heating means, especially electrical energy, heated air, or fuel, can be supplied by way of a bearing, by means of which the heating means is rotatably supported on the mounting device.

Alternatively, the heating means could also be permanently attached directly to the feed arrangement, especially to the twisting basket or to the preform head, line of the heating means, by means of which the fuel or electrical energy can be supplied, is in this case advisably also arranged on the feed arrangement, preferably in the previously mentioned free space, or is guided through the feed arrangement. The required energy or fuel is advisably fed by way of a bearing, by means of which the feed arrangement is rotatably supported in the device.

In the preferred embodiment, an empty space is provided between the stationary part and the rotatable part of the bearing to supply the fuel; the fuel is to be conducted through this space. The stationary part of the bearing is advisably connected to a fuel source, whereas the rotatable part is connected to the burner. It is obvious that the empty space is sealed off against the outside, preferably by means of a sliding ring seal or a contactless seal, to prevent uncontrolled escape of the fuel.

To transmit the electrical energy from the stationary part to the rotatable part of the bearing, means for sliding contact are advisably provided, which are connected on one side to an energy source and on the other side to the previously mentioned line. The electrically operated heating means can be thus be supplied continuously with current.

In an elaboration of the invention, a generator is provided to provide energy for the electrically operated heating installation; this generator is preferably set up to act as a dynamo to recover energy directly from the rotational movement of the feed arrangement. The transmission of the electrical energy via the bearing is then no longer necessary.

In a preferred embodiment of the invention, the heating means is provided with thermal insulation means, which preferably comprises a shielding. As a result of this thermal insulation, the heat can be focused more effectively; the heating of the environment can be avoided more completely; and energy can be conserved more efficiently. It has been found especially advantageous for the thermal insulation to be provided in such a way that it surrounds in a tubular manner the cord to be heated.

BRIEF DESCRIPTION OF THE DRAWING

The invention is explained in greater detail below on the basis of exemplary embodiments and the attached drawings, which refer to the exemplary embodiments.

DETAILED DESCRIPTION OF THE INVENTION

Figure 1:
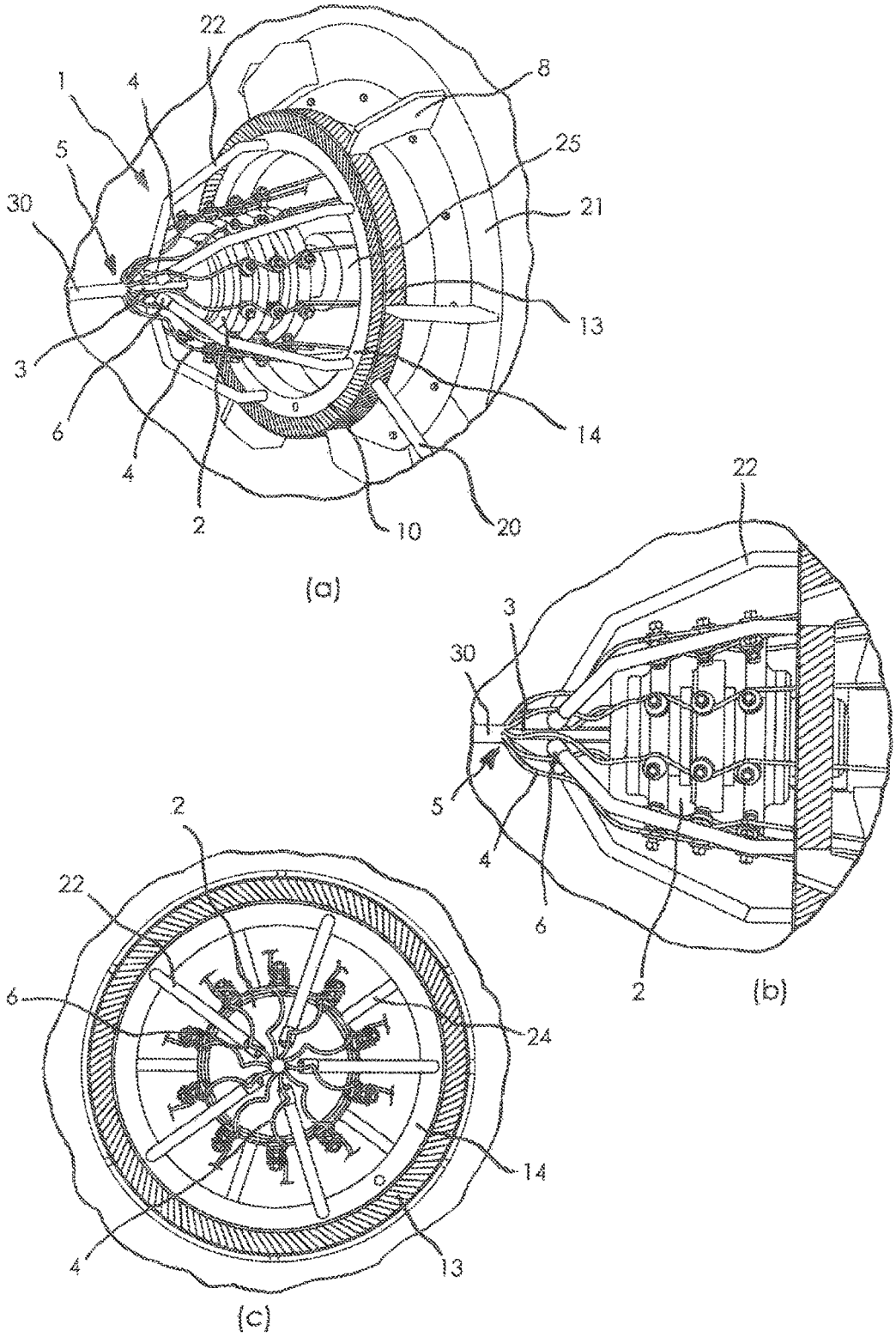
FIG. 1 shows various views of a device according to the invention.

FIG. 1 shows part of a twisting machine, which comprises a carrier body 21, only part of which is shown, in which a preform head 2 is rotatably arranged.

During the production of a wire cable 30, a core cable 3, which is provided with a plastic sheath, and wire strands 4, which are preformed by means of the preform head 2, are supplied via the preform head 2 to a twisting point 5, and, under rotation of the preform head 2 around its longitudinal axis, twisted to form the wire cable 30.

A mounting device 8 for a heating installation 1 is mounted on the carrier body 21; the heating installation comprises five gas burners 6, which are directed toward the core cable 3 and to which gas can be supplied via gas lines 22. The mounting device 8 comprises a rotary bearing 10, which comprises a fixed outer ring 13 and a inner ring 14, which rotates in the outer ring 13. The inner ring 14 is connected to the preform head 2 or to a shaft 25 driven by the preform head by way of struts 24 (shown only in FIG. 1*c*), so that the inner ring 14 is carried along with the rotation of the preform head 2. A feed gas line 20 leads to the outer ring 13; by means of this line, fuel gas can be conducted into the empty space 15 inside the rotary bearing 10, as can be seen especially clearly in FIG. 2.

The empty space 15 is formed between two ball bearings 18, 19 and extends around the entire circumference of the rotary bearing 10. It is sealed off against the outside by a contactless seal 17, such as a throttle seal, especially a throttle gap seal or a throttle labyrinth seal, or by an air purge seal or a slip ring seal, so that gas supplied through the line 20 can flow through the empty space 15 to the burners 6 via the gas lines 22 provided on the inner ring 14 of the rotary bearing 10.

In the production of the wire cable 30, the inner ring 14, the gas lines 20, and the burners 6 rotate in synchrony with the preform head 2, wherein the fuel gas is conducted through the feed gas line 20 to the empty space 15 in the rotary bearing 10 and from there through the lines 22 to the burners 6. As is especially clear from FIG. 1*c*, the burners 6 are aimed at the core cable 3. They heat a layer of plastic (not shown in detail), which is provided on the core cable 3. The plastic layer is softened as a result, so that the wire strands 4 are pressed into the plastic as they are being twisted at the twisting point 5.

The wire strands 4 are heated by the burners 6 to only a minor extent.

Because the heating installation 1 according to the invention makes it possible to control the heating temperature effectively, the device according to the invention can also be used to anneal the core cable 3 and possibly the wire strands 4 to relieve their internal stresses during the twisting process. As a result, the mechanical properties of the cable 30 thus produced are improved. For this purpose, additional gas burners (not shown) aimed directly at the wire strands 4 could also be provided.

It would also be conceivable to provide gas burners which are aimed only at the wire strands 4 and to heat the wire strands 4 in such a way that they heat the plastic sheath around the core cable 3 at the twisting point 5 in such a way that they are pressed into the plastic sheath as the plastic softens.

Figure 2:
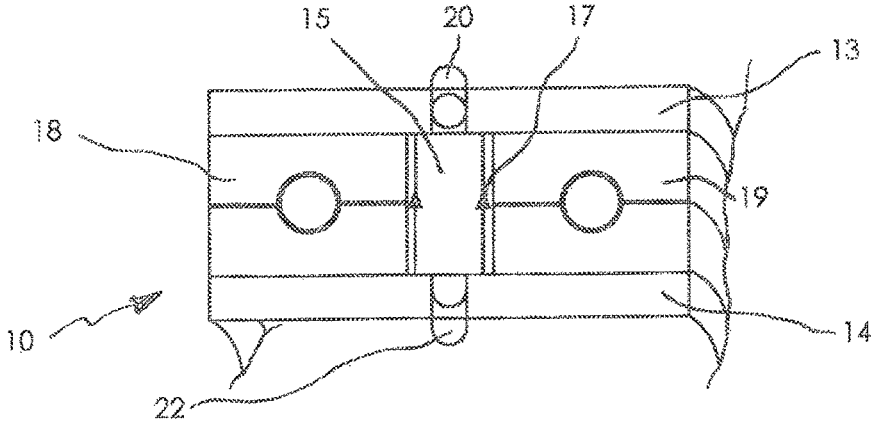
FIG. 2 shows a cross section of part of the device according to FIG. 1.
Figure 4:
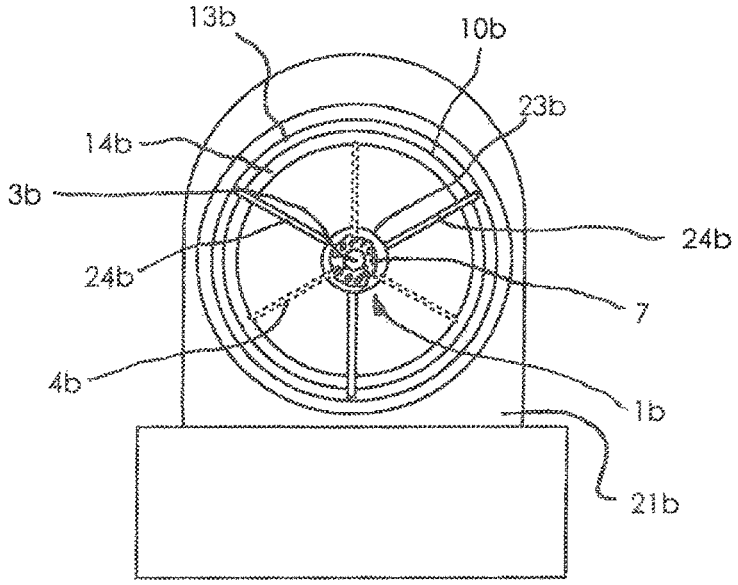
FIG. 4 shows a schematic front view of par another device according to the invention.
Figure 5:
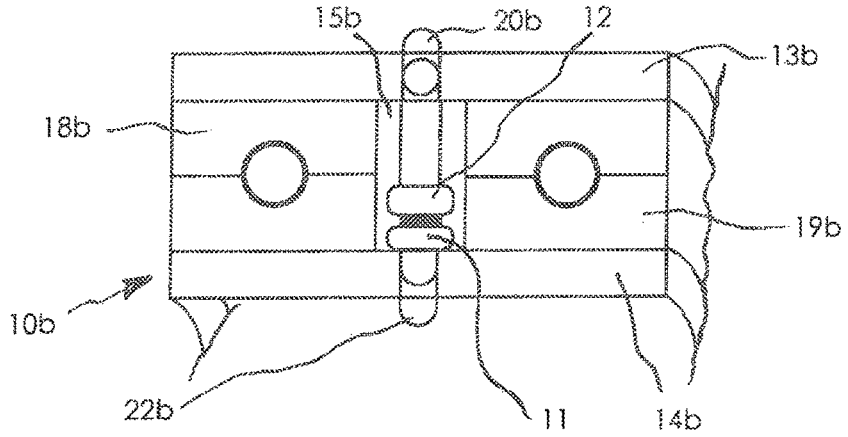
FIG. 5 shows a cross section of part of the device according to FIG. 4.
Figure 3:
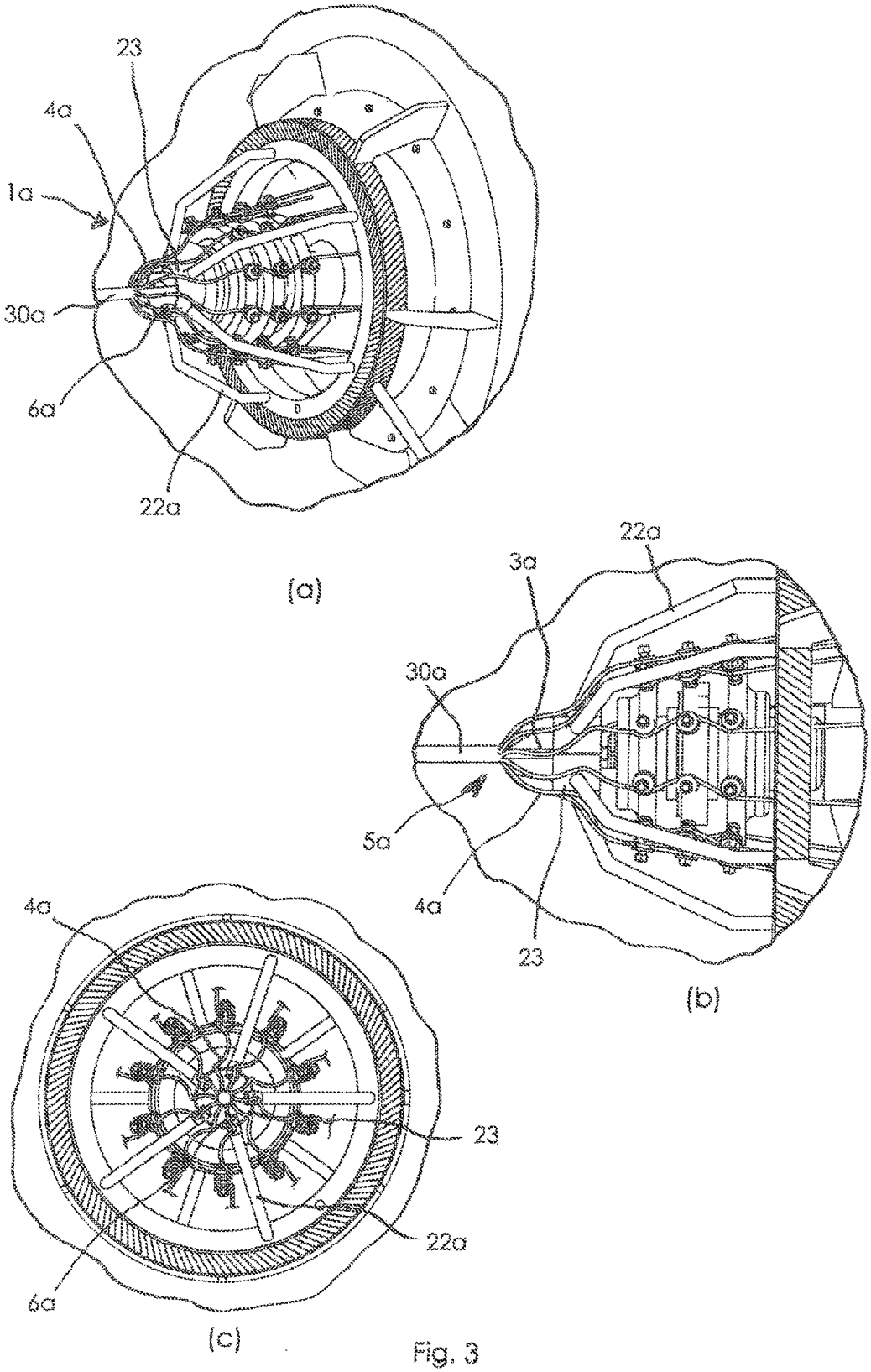
FIG. 3 shows various views of another device according to the invention.

FIGS. 3-5 will now be described, where parts which are the same as, or similar to, parts of FIGS. 1-3 are designated by the same reference numbers as those used in those previous figures, in which case a letter designation is added to the reference number in question.

As can be seen in FIG. 3, a tube 23 can be arranged around the core strand 3*a* in the area upstream, with respect to the twisting direction, of the twisting point 5*a*; the burners 6*a* open out into this tube. The tube 23 is intended to shield the outside area from the heat generated by the burners 6*a*. As a result, less gas is required to heat the plastic, and in addition the wire strands 4*a* are protected from becoming overheated by the burners 6*a*.

FIG. 4 shows part of another device according to the invention, in which the heating means 1*b* is formed not by the previously mentioned burners 6 by rather by a heating resistor 7, which is arranged around a core cable 3*b*. The heating resistor 7 is mounted by brackets 24*b* on a rotary bearing 10*b*, which is arranged on a carrier body 21*b* of the device.

The electrical energy required to heat the heating resistor 7 is supplied via electrical lines 20*b*, which are guided along the brackets 24*b* to the rotary bearing 10*b* and transferred across the rotary bearing 10*b* by means of the sliding contact shown in FIG. 5. The sliding contact is arranged in the empty space 15*b* provided between the ball bearings 18*b*, 19*b* of the rotary bearing 10*b* and comprises a slip ring 12, which is connected to the electrical line 20*b*, and a brush 11 in electrical contact with the slip ring 12.

During the production of a wire cable, the heating resistor 7 and the brackets 24*b* rotate along with the preform head 2*b* during the twisting process. It is supplied with electrical energy via the electrical lines 20*b*, 22*b* and the sliding contact.

In another exemplary embodiment (not shown), at least one induction coil, instead of a heating resistor 7, is arranged around the core cable 3*b* to heat the core cable 3*b* by induction.

Alternatively or in addition to the previously mentioned means for heating the core cable 3, 3*b*, it would also be possible to provide an infrared radiator and/or a line through which hot air could be directed onto the core cable.

The invention claimed is:

1. A device for producing a strand or cable, the device comprising: a rotatable feed arrangement for feeding cords to a twisting point, at which the cords are to be twisted around a core strand of the strand or a core cable for forming the strand or the cable, and an installation for heating the core strand or the core cable, wherein the heating installation is rotatable together with the feed arrangement, the heating installation being arranged to apply heat to the core strand or the core cable in an area in which the cords are guided from the rotatable feed arrangement to the twisting point, wherein the heating installation is arranged in free spaces between the cords leading to the twisting point so as to focus heat on the core strand or the core cable, so that the core strand or the core cable is heated more strongly than the cords and strong heating of the cords is avoided.

2. The device according to claim 1, wherein the electrically operated heating device is one of a heating resistor, an infrared radiator and an induction coil.

3. The device according to claim 1, wherein the heating installation comprises thermal insulation.

4. The device according to claim 3, wherein the thermal insulation is a shielding.

5. The device according to claim 3, wherein the thermal insulation surrounds the cord to be heated in a tubular manner.

6. A method for producing a strand or a cable, comprising the steps of: moving cords with a rotatable arrangement for feeding the cords to a twisting point; twisting the cords around a core strand of the strand or a core cable of the cable to form the strand or the cable; and heating the core strand or the core cable by a heating installation arranged in free spaces between the cords leading to the twisting point, wherein the heating installation rotates together with the feed arrangement during the twisting step, wherein the heating installation applies heat to the core strand or the core cable in an area in which the rotating strands are guided from the rotatable feed arrangement to the twisting point and focuses the heat on the core strand or the core cable, so that the core strand or the core cable is heated more strongly than the cords and strong heating of the cords is avoided.

7. The method according to claim 6, including heating a cord provided to form a core strand or a core cable and/or heating cords provided to form outer strands.

8. The method according to claim 6, including annealing at least one of the cords to relieve internal stress.

9. A device for producing a strand or cable, the device comprising: a rotatable feed arrangement for feeding cords to a twisting point, at which the cords are to be twisted together; and an installation for heating at least one of the cords, wherein the heating installation comprises at least one of a burner for fuel or an arrangement for supplying a heated gas, wherein the heating installation is rotatable together with the feed arrangement the device being configured to supply the heated gas or fuel for operating the heating installation through a bearing of the feed arrangement, by which bearing the feed arrangement is rotatably supported in the device, or through a bearing of the heating installation, by which bearing the heating installation is rotatably supported in a mounting device, wherein the bearing of the heating installation has a stationary part and a rotatable part, wherein an empty space is provided between the stationary part and the rotatable part, through which empty space the fuel or the heated gas is conducted, the empty space being externally sealed by a slip ring seal or a contactless seal.

10. The device according to claim 9, wherein the heating installation is set up to heat a cord provided to form a core strand or core cable and/or to heat cords provided to form outer strands.

11. The device according to claim 9, wherein the heating installation is arranged on the feed arrangement or on a mounting device attached to a base.

12. The device according to claim 9, wherein an empty space is provided between a stationary part and a rotatable part of the bearing of the heating installation through which the fuel or the heated gas is conducted.

13. A method for producing a strand or a cable, comprising the steps of: moving cords with a rotatable arrangement for feeding the cords to a twisting point; twisting the cords to form the strand or the cable; and heating at least one of the cords by a heating installation comprising at least one of a burner for fuel or an arrangement for supplying a heated gas, wherein the heating installation rotates together with the feed arrangement during the twisting step, and the fuel or the heated gas for operating the heating installation is supplied through a bearing of the feed arrangement, by which bearing the feed arrangement is rotatably supported in the device, or through a bearing by which the heating installation is rotatable in a mounting device, wherein the fuel or the heated gas is conducted through an empty space provided between a stationary part and rotatable part of the bearing of the heating installation, the empty space being externally sealed off by a slip ring seal or a contactless seal.

14. The method according to claim 13, wherein the at least one cord comprises a plastic sheath and is heated so that the plastic sheath softens.

15. The method according to claim 14, wherein several of the cords are covered by the plastic sheathing and, as a result of the heating installation, the plastic on each of the cords is heated to a softening point.

16. The method according to claim 13, including annealing at least one of the cords to relieve internal stress.

* * * * *